US009399355B2

(12) United States Patent
Sawai et al.

(10) Patent No.: US 9,399,355 B2
(45) Date of Patent: Jul. 26, 2016

(54) PRINTING METHOD, PRINTING APPARATUS, AND COMPUTER-READABLE STORAGE MEDIUM

(71) Applicant: CANON KABUSHIKI KAISHA, Tokyo (JP)

(72) Inventors: Yuki Sawai, Kawasaki (JP); Minoru Teshigawara, Saitama (JP); Yoshiaki Murayama, Tokyo (JP); Kentarou Muro, Tokyo (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/699,108

(22) Filed: Apr. 29, 2015

(65) Prior Publication Data

US 2015/0314610 A1 Nov. 5, 2015

(30) Foreign Application Priority Data

May 1, 2014 (JP) ..... 2014-094815

(51) Int. Cl.
*B41J 2/15* (2006.01)
*B41J 2/21* (2006.01)

(52) U.S. Cl.
CPC ..... *B41J 2/2121* (2013.01)

(58) Field of Classification Search
CPC .... B41J 2/0451; B41J 2/16517; B41J 2/2132; B41J 2/04598
See application file for complete search history.

(56) References Cited

U.S. PATENT DOCUMENTS 5,903,288 A 5/1999 Yamaguchi
2009/0267981 A1 10/2009 Tsuchii

*Primary Examiner* — Lamson Nguyen
(74) *Attorney, Agent, or Firm* — Canon USA, Inc. IP Division

(57) ABSTRACT

Printing an image on a printing medium includes using a print head that ejects a first ink and a second ink having higher lightness than the first ink with preliminary ejection that is performed in a predetermined area in which the image is to be formed in order to maintain an ink ejection state of the print head and that does not contribute to printing of the image, wherein dots of the first ink and dots of the second ink formed in the predetermined area by the preliminary ejection are printed so as to be superposed on each other.

20 Claims, 14 Drawing Sheets

FIG. 12A

| NOZZLE ARRAY | Y | M | C | K |
|---|---|---|---|---|
| MASK PATTERN (FORWARD DIRECTION) | 2 | 1 | 1 | 1 |

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| K | | | | | | | | | | C | | | | | Y | | | | | M | | | | | | | | | | | |
| | | | | | | Y | | | | | | | | | | C | | | | | K | | | | | M | | | | |
| | | M | | | | | | | | | | K | | | | | | | | | | C | | | | | Y | | | |
| | | | K | | | | | M | | | | | | | | | | Y | | | | | | | | | | C | | |
| | | | | C | | | | | Y | | | | | M | | | | | | | | | | K | | | | | | |
| K | | | | | M | | | | | | | | | | Y | | | | | | | | | | C | | | | | |
| | C | | | | | Y | | | | | M | | | | | | | | | | K | | | | | | | | | |
| | | | | | | | C | | | | | K | | | | | M | | | | | | | | | | Y | | | |
| | | | Y | | | | | | | | | | C | | | | | K | | | | | M | | | | | | | |
| | | | | | | | | | K | | | | | | | | | | C | | | | | Y | | | | | | M |
| Y | | | | | | | | | | C | | | | | K | | | | | M | | | | | | | | | | | |
| | | | | | | K | | | | | | | | | | C | | | | | Y | | | | | M | | | | | |
| | | M | | | | | | | | | | Y | | | | | | | | | | C | | | | | K | | | |
| | | | K | | | | | M | | | | | | | | | | Y | | | | | | | | | | C | | |
| | | | | C | | | | | Y | | | | | M | | | | | | | | | | K | | | | | | M |

FIG. 12B

| NOZZLE ARRAY | Y | M | C | K |
|---|---|---|---|---|
| MASK PATTERN (FORWARD DIRECTION) | 2 | 1 | 1 | 1 |
| MASK PATTERN (BACKWARD DIRECTION) | 1 | 2 | 2 | 2 |

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| KY | | | | | M | | | | | C | | | | | YK | | | | | M | | | | | C | | | | | |
| | C | | | | | YK | | | | | M | | | | | C | | | | | KY | | | | | M | | | | |
| | | M | | | | | C | | | | | KY | | | | | M | | | | | C | | | | | YK | | | |
| | | | KY | | | | | M | | | | | C | | | | | YK | | | | | M | | | | | C | | |
| | | | | C | | | | | YK | | | | | M | | | | | C | | | | | KY | | | | | M |
| KY | | | | | M | | | | | C | | | | | YK | | | | | M | | | | | C | | | | | |
| | C | | | | | YK | | | | | M | | | | | C | | | | | KY | | | | | M | | | | |
| | | M | | | | | C | | | | | KY | | | | | M | | | | | C | | | | | YK | | | |
| | | | YK | | | | | M | | | | | C | | | | | KY | | | | | M | | | | | C | | |
| | | | | C | | | | | YK | | | | | M | | | | | C | | | | | YK | | | | | M |
| YK | | | | | M | | | | | C | | | | | KY | | | | | M | | | | | C | | | | | |
| | C | | | | | KY | | | | | M | | | | | C | | | | | YK | | | | | M | | | | |
| | | M | | | | | C | | | | | YK | | | | | M | | | | | C | | | | | KY | | | |
| | | | KY | | | | | M | | | | | C | | | | | YK | | | | | M | | | | | C | | |
| | | | | C | | | | | YK | | | | | M | | | | | C | | | | | KY | | | | | M |

PRINTING METHOD, PRINTING APPARATUS, AND COMPUTER-READABLE STORAGE MEDIUM

BACKGROUND

1. Field

Aspects of the present invention generally relate to a printing method, a printing apparatus, and a computer-readable storage medium.

2. Description of the Related Art

In an ink jet printing apparatus, drying of ink in or around nozzles of a print head may cause thickening of the ink, leading to an ejection failure. A method known in the art for preventing such a failure is to perform an operation, called "preliminary ejection", of ejecting thickened ink to an ink receiver including an ink absorbing member prior to image printing. In a serial printer configured in such a manner that a print head is moved relative to a printing medium to print an image, preliminary ejection is typically executed in a predetermined position outside the printing medium.

A known full multiple printer is configured in such a manner that a plurality of print heads are arranged across the entire width of a printing medium and the printing medium is conveyed relative to the print heads, which are fixed, to print an image. In the full multiple printer, the execution of only preliminary ejection outside a printing medium leads to a long time interval between the preliminary ejections. Disadvantageously, it is difficult to maintain proper ejection performance. In addition, image printing has to be suspended and the print heads or an ink receiver has to be moved, leading to low throughput. Another known way of preliminary ejection, called "paper preliminary ejection", is to preliminarily eject ink onto a printing medium to be subjected to image printing. After start of printing an image on a printing medium, the paper preliminary ejection and the printing can be performed simultaneously without suspension of the printing. Thus, the paper preliminary ejection achieves a good balance between maintaining high quality of a printed image and suppressing a reduction in throughput.

Since the paper preliminary ejection is performed such that ink is ejected onto a printing medium on which an image is to be formed, dots formed on the printing medium may be visible to a user depending on the density or amount of ink, resulting in a reduction in printing quality. One of methods addressing this issue is described in U.S. Patent Application Publication No. 2009/0267981. According to this method, when paper preliminary ejection is performed on a color image, data for the paper preliminary ejection is deleted. This suppresses an increase in dot diameter, thus making dots formed by the paper preliminary ejection less visible. Furthermore, U.S. Pat. No. 5,903,288 describes a method of forming color-ink dots for paper preliminary ejection such that the color-ink dots are superposed on black-ink dots in accordance with data indicating that black ink is to be ejected to an area facing nozzles requiring preliminary ejection in a print head.

U.S. Patent Application Publication No. 2009/0267981 and U.S. Pat. No. 5,903,288 describe the methods of ejecting ink for paper preliminary ejection to a position based on ejection data in an image to be printed. In an area where dots are not formed in a printed image, the visibility of dots formed by paper preliminary ejection is not reduced. In particular, if the dots formed by paper preliminary ejection significantly differ in lightness from a printing medium or an image formed around the dots, the dots formed by the paper preliminary ejection will be more visible.

SUMMARY

Aspects of the present invention generally provide a method of printing an image on a printing medium using a print head ejecting a first ink and a second ink having higher lightness than the first ink, the method including preliminarily ejecting the first ink in a predetermined area, preliminarily ejecting the second ink in the predetermined area, and ejecting ink in the predetermined area to form the image, wherein preliminarily ejecting the first ink and the second ink maintains an ink ejection state of the print head without contributing to printing of the image, and wherein dots of the first ink and dots of the second ink formed in the predetermined area by the preliminary ejection are printed so as to be superposed on each other.

Further features of the present disclosure will become apparent from the following description of exemplary embodiments with reference to the attached drawings.

BRIEF DESCRIPTION OF THE DRAWINGS

FIGS. 12A and 12B are schematic diagrams each illustrating arrangement of dots to be formed by paper preliminary ejection in the second embodiment.

DESCRIPTION OF THE EMBODIMENTS

First Embodiment

A first exemplary embodiment will be described in detail with reference to the drawings.

Figure 1:
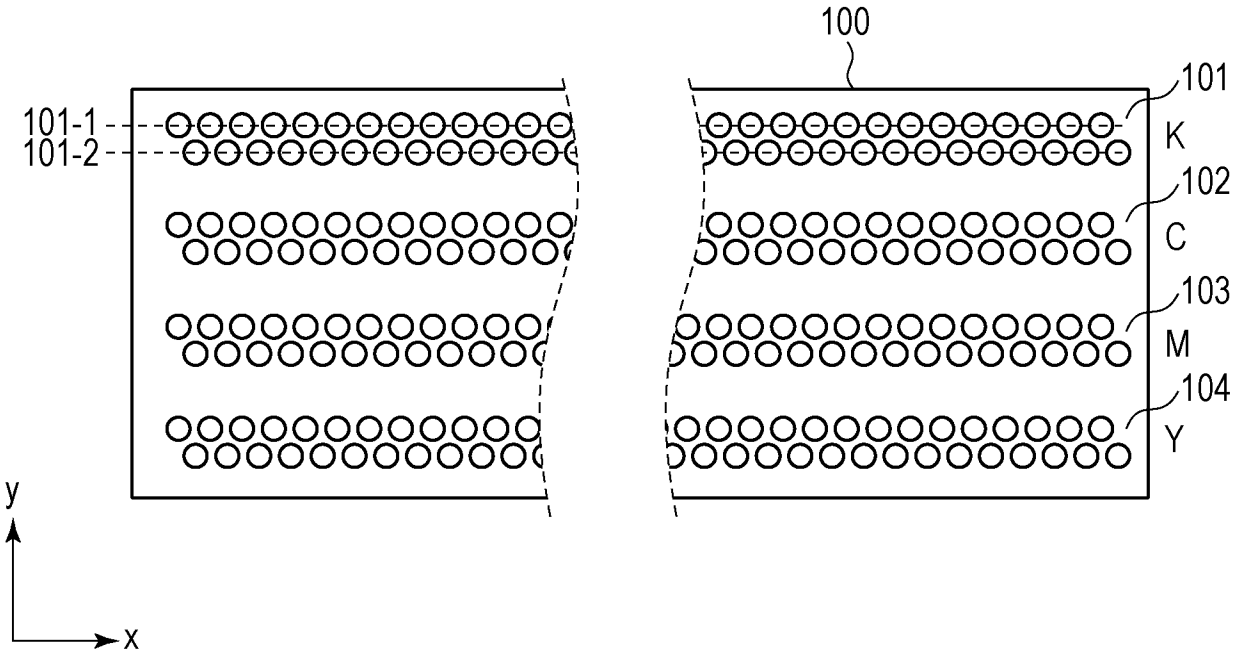
FIG. 1 is a schematic diagram partly illustrating nozzle arrays of a print head in a first embodiment.

FIG. 1 is a diagram explaining a printing unit of an ink jet printing apparatus (hereinafter, referred to as a "printer") in the present embodiment. A print chip (ejection substrate) 100 includes a plurality of nozzle arrays 101 to 104, each serving as an array of nozzles for ejecting ink. Specifically, the print chip 100 includes the nozzle array 101 for black (K) ink, the nozzle array 102 for cyan (C) ink, the nozzle array 103 for magenta (M) ink, and the nozzle array 104 for yellow (Y) ink. Since the nozzle arrays have the same configuration, the configuration of the nozzle array 101 for black ink will be described below. The nozzle array 101 includes two nozzle rows 101-1 and 101-2 each including the nozzles arranged at a resolution of 600 dpi. The nozzle row 101-1 is misaligned with the nozzle row 101-2 by a half pitch in a direction (x direction in FIG. 1) in which the nozzles are arranged. Specifically, the nozzle rows are misaligned with each other in the x direction by 1/1200 inches. The two nozzle rows print rasters misaligned with each other by 1/1200 inches, so that an image can be printed at a print resolution of 1200 dpi in the direction in which the nozzles are arranged. The print head in this embodiment ejects ink utilizing thermal energy and includes, as printing elements, electrothermal transducing elements for producing thermal energy in the nozzles. The method of ejecting ink is not limited to the method utilizing thermal energy. Ink may be ejected by any other method, for example, using piezoelectric transducers.

Figure 2:
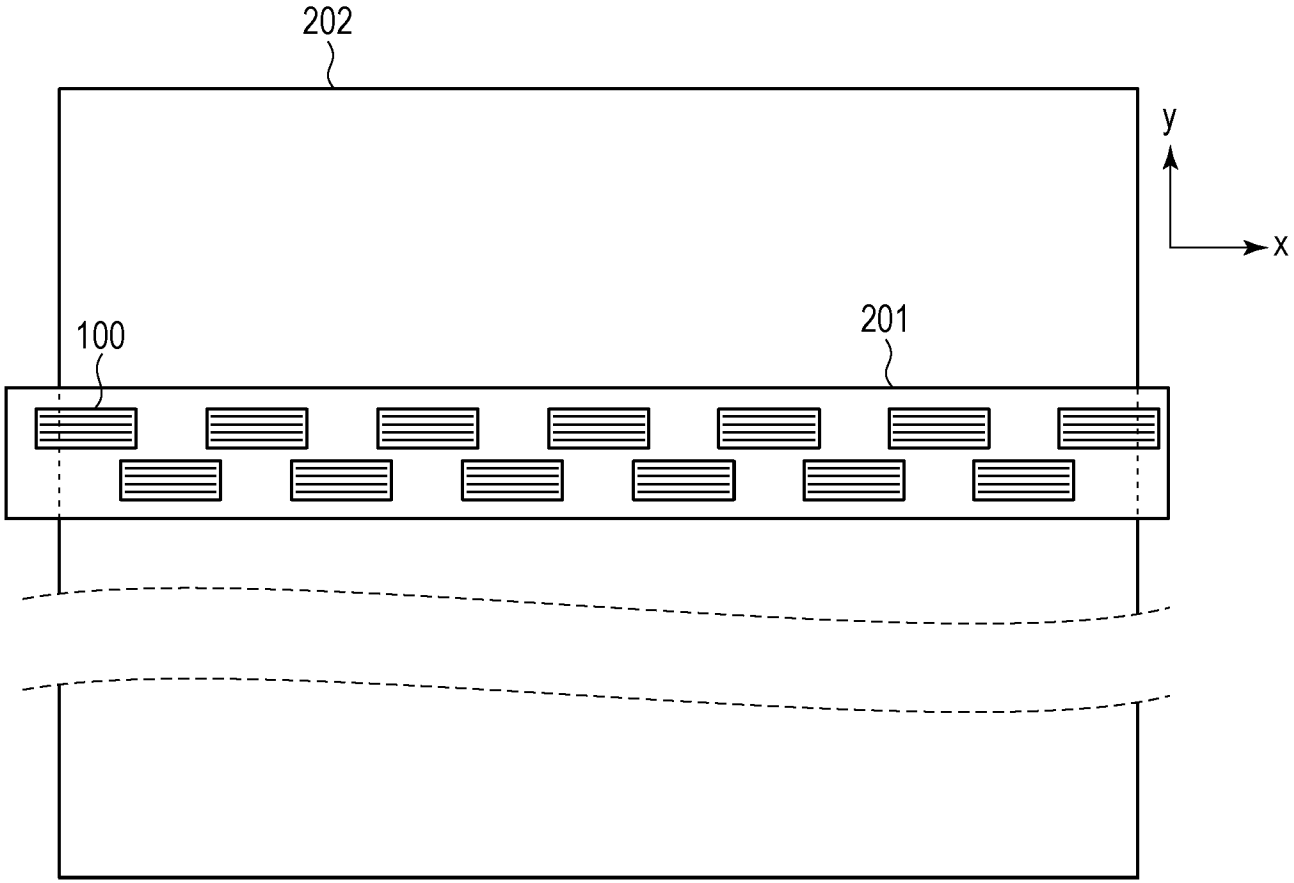
FIG. 2 is a schematic diagram illustrating an exemplary configuration of the print head extending across the entire width of a printing medium.

FIG. 2 is a diagram illustrating positional relationship between a print head 201 and a printing medium 202. The print head 201 includes the print chips 100 staggered in a direction orthogonal to a printing medium conveying direction. In the x direction in FIG. 2, a printable width of the print head 201 is wider than the width of the printing medium 202. The printing medium 202 is conveyed in a y direction upwardly in FIG. 2. Each print chip 100 includes the nozzle arrays such that the nozzle arrays for the Y, M, C, and K inks are arranged in that order from an upstream side in the printing medium conveying direction. In other words, ink droplets are applied to the printing medium 202 in this order of the Y, M, C, and K inks, thus forming dots.

Figure 5:
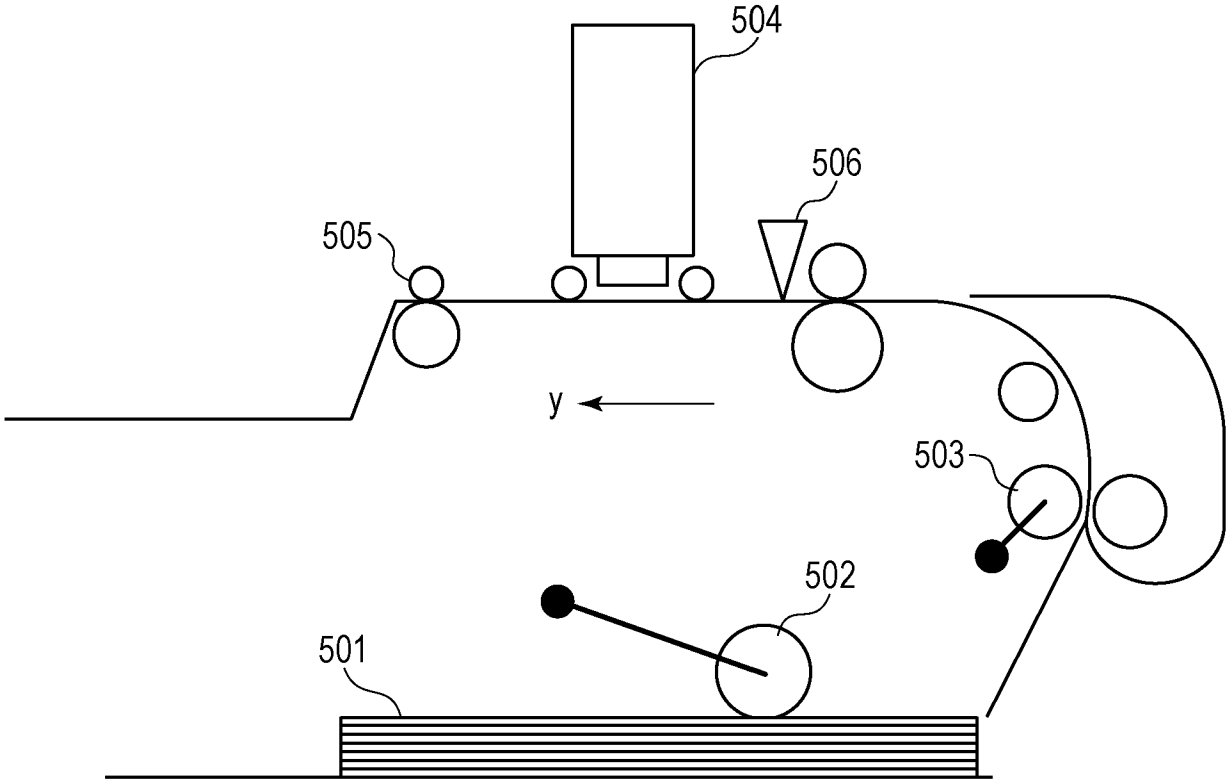
FIG. 5 is a schematic diagram illustrating an exemplary configuration of a printing medium conveying mechanism in a printing apparatus.

FIG. 5 illustrates a path through which the printing medium 202 is conveyed in the printer. A printing medium storage unit 501 stores printing media. A pickup roller 502 separates the recording media one by one. The printing medium 202 is conveyed via an intermediate roller 503 to a printing unit 504. The printing unit 504 includes the above-described print head 201. A printing medium sensor 506 is disposed just before the printing unit 504. When a leading edge of the printing medium 202 reaches the printing medium sensor 506, the printing medium sensor 506 outputs an ON signal, and whether the printing medium 202 is conveyed normally, namely, whether the printing medium 202 can be subjected to printing is determined. If the printing medium 202 is not detected by the printing medium sensor 506 when a predetermined period of time has elapsed since driving of the pickup roller 502, it is determined that the printing medium 202 has not been conveyed normally, a printing operation is suspended, and a user is informed of a paper-jamming error. If the printing medium 202 is detected in the predetermined period of time, it is determined that the printing medium 202 has been conveyed normally, conveying of the printing medium 202 is continued, and the printing medium 202 is allowed to pass under the printing unit 504. The printing unit 504 ejects ink droplets from the nozzles onto the conveyed printing medium 202 in accordance with print data generated by image processing, thus printing an image. The printing medium 202 is conveyed to a discharging roller unit 505 during printing of the image and the printing medium sensor 506 detects a trailing edge of the printing medium 202. At completion of such a printing operation based on the print data, the printing medium 202 is discharged from the printer by the discharging roller unit 505. Although the conveyance of the printing medium by a plurality of rollers has been described in the embodiment, the printing medium may be conveyed by a belt.

During non-printing, a nozzle face, where the nozzles are arranged, of the printing unit 504 is sealed with a cap unit (not illustrated). Sealing of the nozzle face with the cap unit can prevent evaporation of water or solvent contained in the ink in the nozzles, thus preventing the nozzles from clogging due to solidification of the ink or a foreign substance. Furthermore, preliminary ejection may be performed such that the ink is ejected from each nozzle to the cap unit, thus maintaining proper ejection performance and avoiding clogging that causes an ejection failure. In addition, a negative pressure may be generated in the cap unit by a pump unit (not illustrated), thus sucking the ink in the nozzles and ejecting the ink to the cap unit. Consequently, the nozzles which have caused an ejection failure can be recovered.

Figure 7:
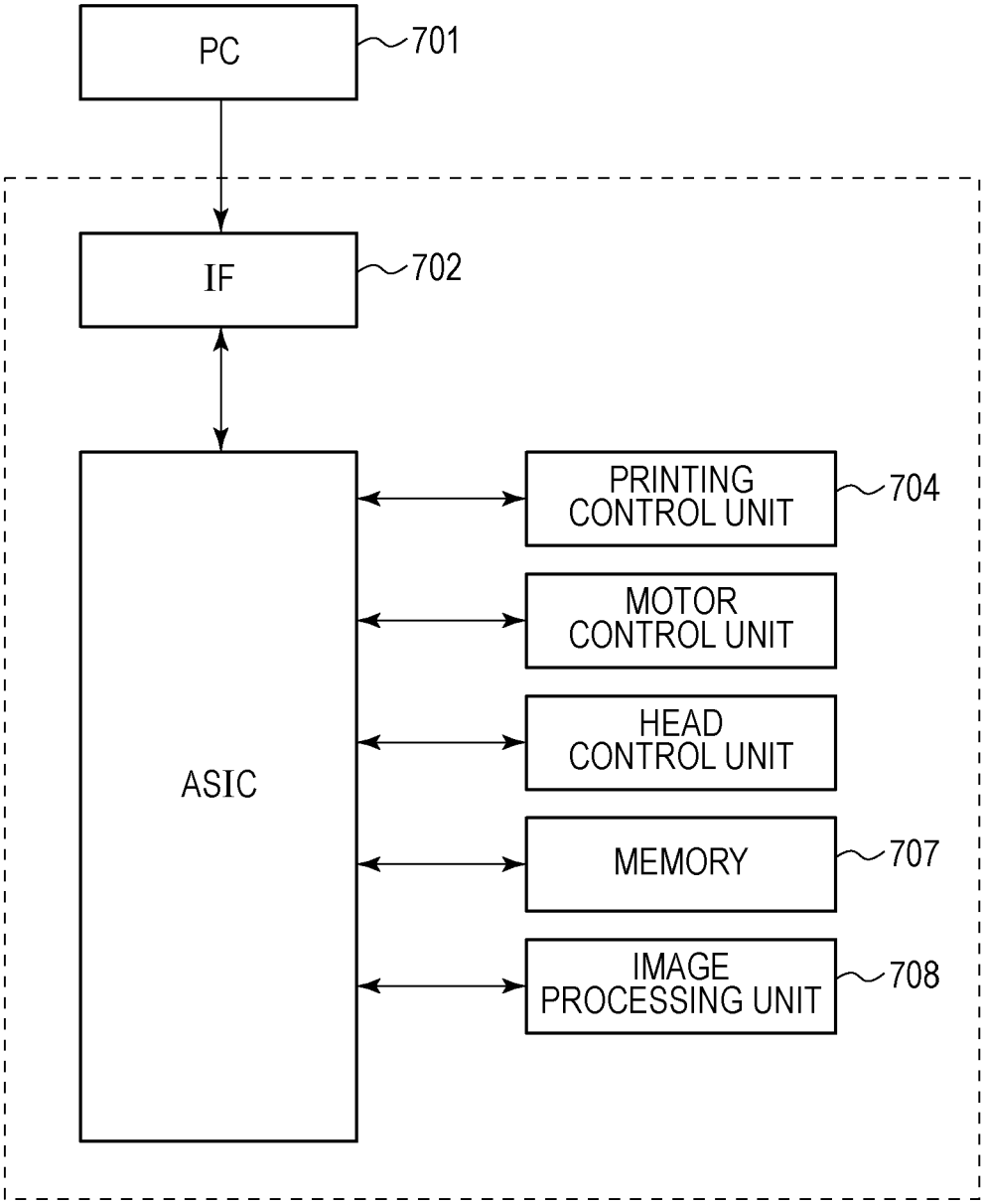
FIG. 7 is a block diagram illustrating an exemplary configuration of the printing apparatus.

FIG. 7 is a block diagram illustrating an exemplary control configuration of the printer. Multivalued image data is supplied from a personal computer (PC) 701, an external memory, or an image input device, such as a scanner or a digital camera, through an interface (IF) 702 of the printer and is stored to a memory 707. The multivalued image data stored in the memory 707 is subjected to image processing by an image processing unit 708, thus generating binary print data indicating ejection and non-ejection of ink. A specific process will be described later with reference to FIG. 8. A printing control unit 704 drives the printing elements in the nozzles relevant to the print data generated by the image processing unit 708, thus ejecting ink. Consequently, an image is formed in a predetermined area of a printing medium.

Figure 8:
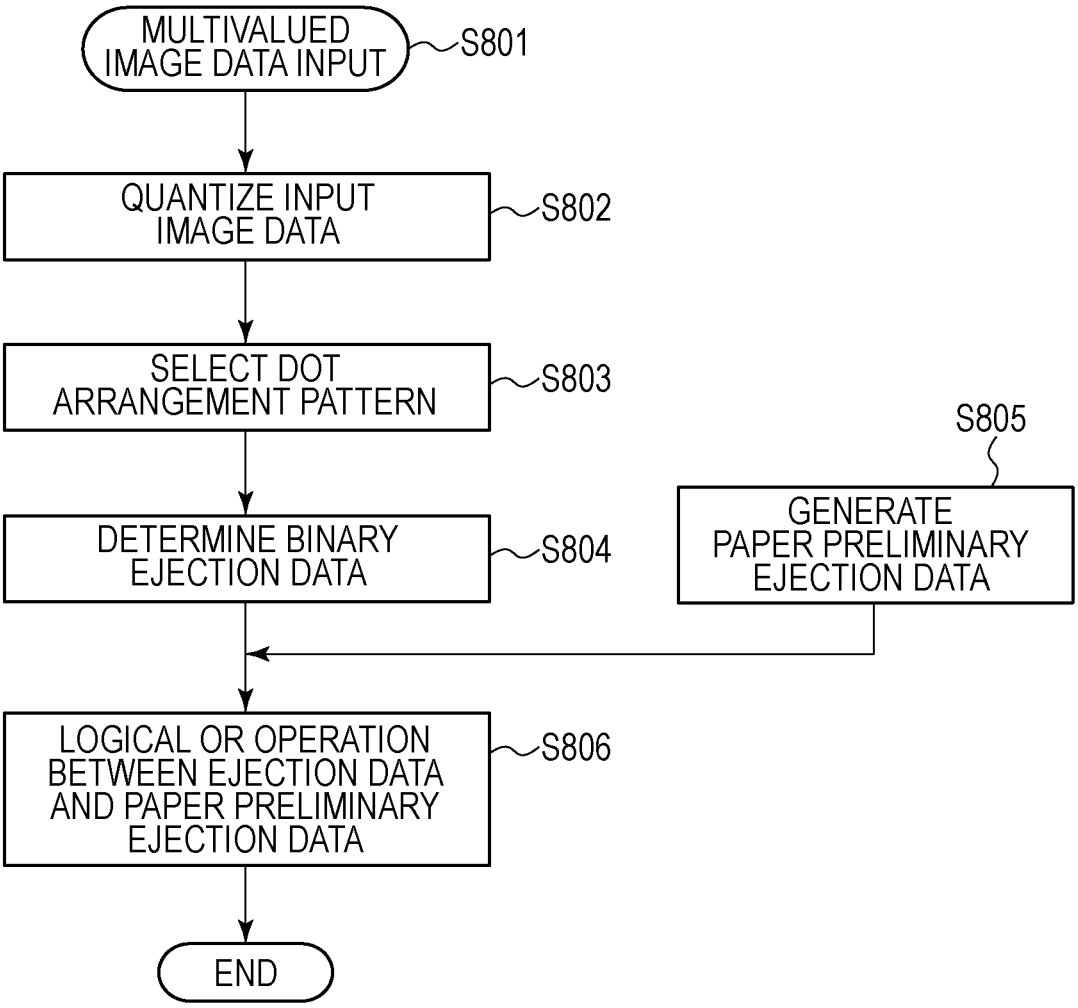
FIG. 8 is a flowchart of image data processing.

FIG. 8 is a flowchart of image processing for multivalued image data. In step S801, multivalued image data stored in the memory 707 is input to the image processing unit 708. In this case, the multivalued image data of eight bits (256 tones) per pixel is input. In step S802, the input multivalued image data is quantized into N-valued image data, where the number N is a natural number greater than or equal to 3 and less than 256. In this case, N=25. In step S803, a dot arrangement pattern corresponding to tone values of pixels is selected based on the quantized 25-valued image data. The dot arrangement pattern is a pattern of binary values indicating the presence or absence of dot formation, namely, ejection or non-ejection of ink. The dot arrangement pattern is selected, thus generating binary print data. In step S804, the binary print data is allocated to the nozzle arrays, thus determining binary ejection data about ejection of the nozzles of the nozzle arrays. In step S805, paper preliminary ejection data about paper preliminary ejection to be performed in order to maintain an ink ejection state of each nozzle during image printing is generated. The paper preliminary ejection is to be performed in an area in which an image is to be printed. Dots formed by the paper preliminary ejection do not contribute to printing of the image. Accordingly, the paper preliminary ejection may be performed at such a density that formed dots are invisible so that the effect of the preliminary ejection on a printed image is minimized as much as possible. In step S806, a logical OR operation between the binary ejection data determined in step S804 and the paper preliminary ejection data generated in step S805 is obtained, thus generating ejection data for driving the printing elements in the nozzles. An image is printed in a predetermined area of a printing medium in accordance with the generated ejection data.

As regards N-valued processing of input halftone image data, any halftone processing, such as a multivalued error diffusion method, an average density storage method, or a dither matrix method, can be used. It is only required that the image processing unit 708 generates binary ejection data based on multivalued image data. The above-described N-valued processing may be omitted. For example, binarization processing for directly converting multivalued image data input to the image processing unit 708 into binary ejection data may be performed.

Although the logical OR operation between the binary ejection data based on the input multivalued image data and the paper preliminary ejection data is performed in the embodiment, the present disclosure is not limited to the embodiment. An exclusive-OR operation between the multivalued image data and the paper preliminary ejection data may be performed so that paper preliminary ejection is performed only in unprinted regions to which ink is not ejected.

Figure 6A:
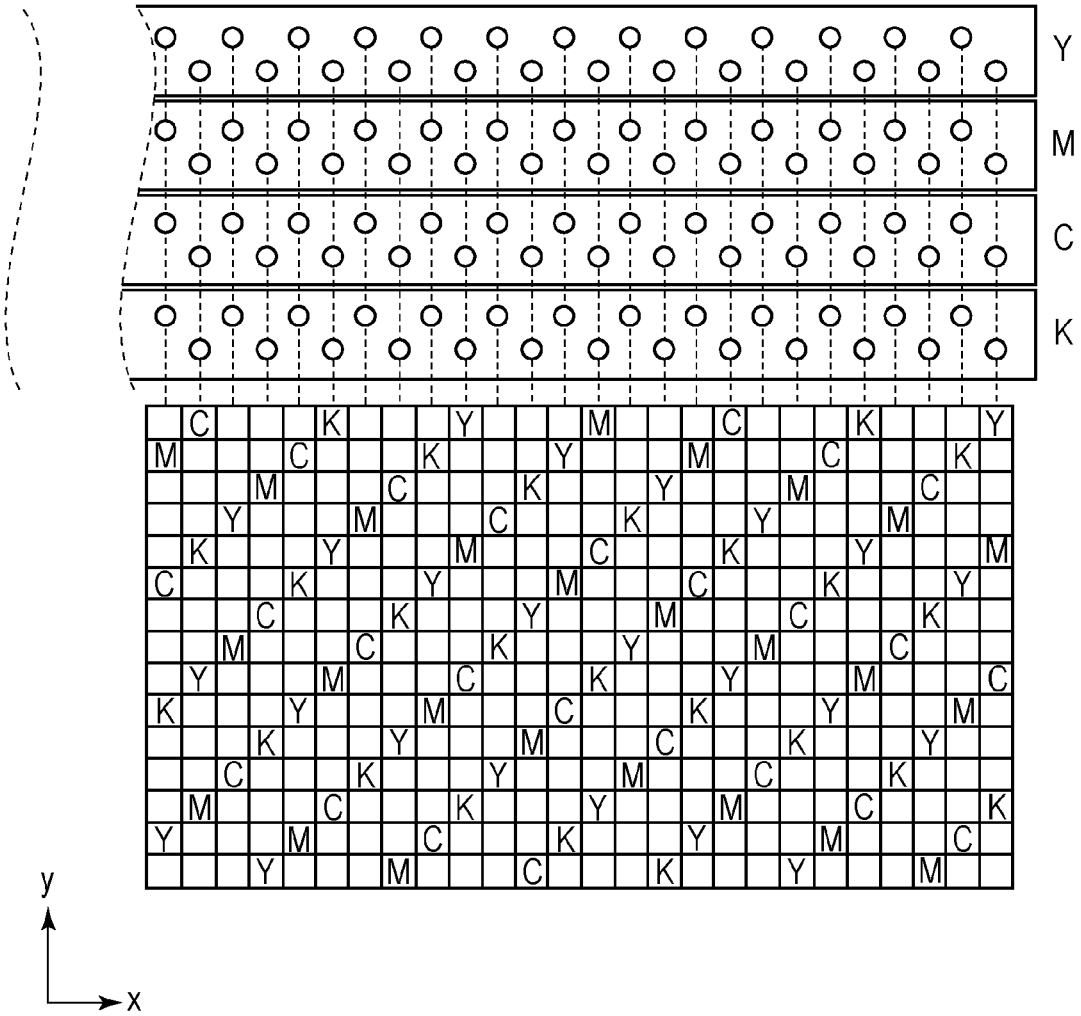
FIGS. 6A and 6B are diagrams each explaining arrangement of dots to be formed on a printing medium by paper preliminary ejection.

FIG. 6A illustrates a pattern based on conventional paper preliminary ejection data. In this preliminary ejection pattern, each rectangular region represents a pixel that is a minimum unit to which ink is to be ejected or not to be ejected. In FIG. 6A, each of pixels with characters Y, M, C, and K is a pixel to which ink of the corresponding color is to be ejected to form a dot. Conventionally, a method of performing offset for each color has been used to make the dots formed by paper preliminary ejection less visible.

Figure 6B:
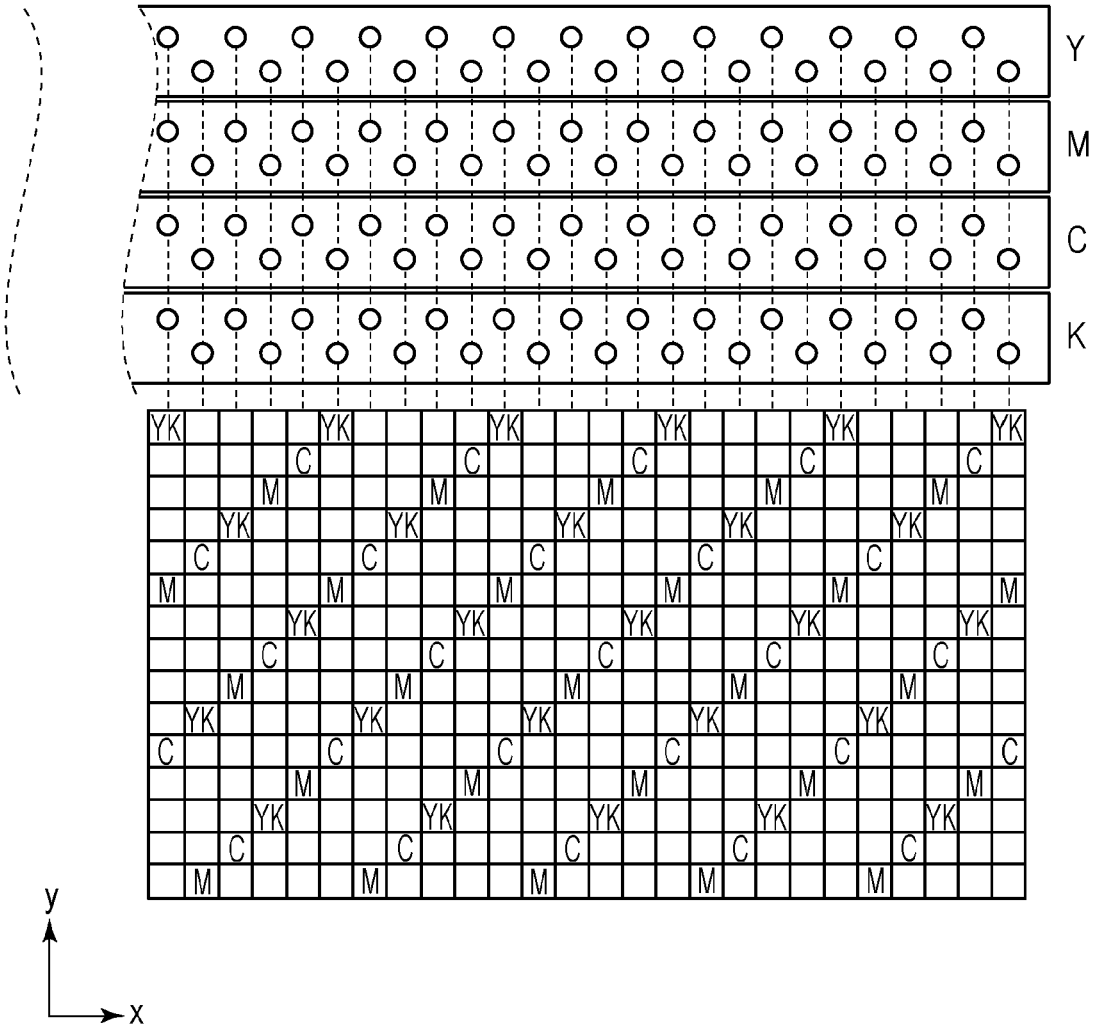

FIG. 6B illustrates a pattern based on paper preliminary ejection data in the embodiment. The paper preliminary ejection data is generated so that ink having low lightness is superposed on ink having high lightness in paper preliminary ejection, thus making dots formed by the paper preliminary ejection less visible. The preliminary ejection pattern in the embodiment allows dots of the black ink having low lightness formed by the paper preliminary ejection to be positioned in pixels identical to those in which dots of the yellow ink having high lightness are formed by the paper preliminary ejection.

A typical preliminary ejection pattern includes blank pixels to avoid continuous printing in the y direction, serving as the printing medium conveying direction, in FIG. 6B. In addition, offset is performed for each color so that a ruled line (transverse line) pattern extending along the nozzle rows is invisible. Consequently, an image with invisible texture is formed. An amount of blank space, an amount of offset, and an offset period may be set as appropriate. Preliminary ejection is not limited to that using a regular paper preliminary ejection pattern as illustrated in FIG. 6B. An irregular pattern formed using the error diffusion method may also be used.

Conventionally, dots formed by paper preliminary ejection have been distributed on a printing medium as much as possible in order to make the dots less visible. On the other hand, the inventors of the present disclosure have paid attention to the fact that an image formed by superposing the black ink and the yellow ink on each other has higher lightness than an image formed with only the black ink, and have adopted a method of forming yellow-ink dots and black-ink dots such that the yellow-ink dots are formed in pixels identical to those in which the black-ink dots are formed. This results in a reduction in the difference in lightness between each region with the dots formed by paper preliminary ejection and its surrounding region, thus making the dots formed by the paper preliminary ejection less visible. Additionally, printing each yellow-ink dot and a corresponding black-ink dot so as to superpose the dots on each other allows the ratio (coverage) of the dots formed by the paper preliminary ejection to a printing medium to be lower than that in printing in which each yellow-ink dot and the corresponding black-ink dot are printed at different positions. In other words, the total number of dots formed on the printing medium is reduced, so that the amount of plain paper exposed (or the amount of blank space) can be increased. This makes the dots formed by the paper preliminary ejection less visible.

In the print head in the embodiment, the nozzle arrays are arranged in this order of the Y, M, C, and K inks in the printing medium conveying direction. Accordingly, ink droplets are applied to the printing medium in this order of the Y, M, C, and K inks. In printing of the paper preliminary ejection pattern of FIG. 6B using this print head, yellow-ink droplets are applied to the printing medium, and after that, black-ink droplets are applied thereto. This allows the lightness of each region with formed dots to be higher than that in a case where the yellow-ink droplets are applied after the black-ink droplets. Such an effect will now be described with reference to FIGS. 9A and 9B.

Figure 9A:
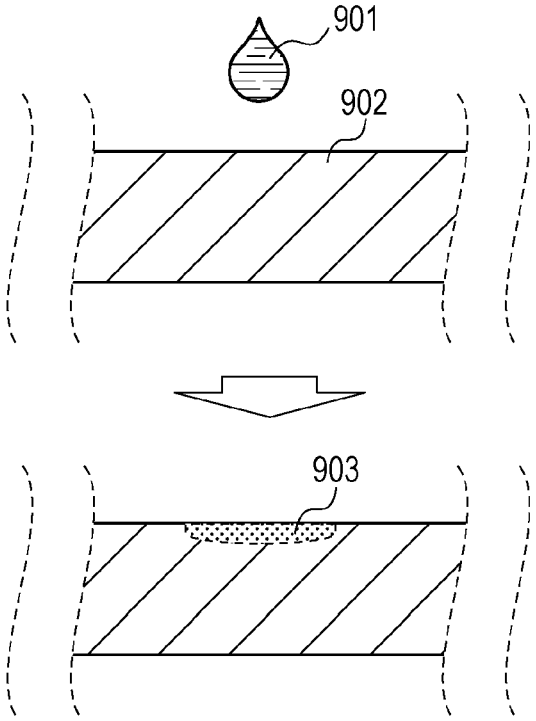
FIGS. 9A and 9B are model diagrams illustrating permeation of ink droplets ejected from a print head.
Figure 9B:
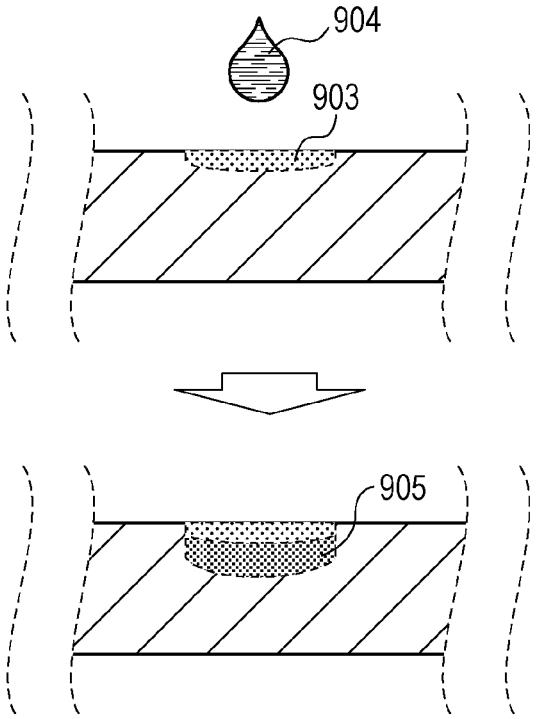

FIGS. 9A and 9B are cross-sectional views of a printing medium and illustrate states of permeation of ink droplets of two different colors applied at a single position in the printing medium. FIG. 9A illustrates formation of only one dot of a first color ink. FIG. 9B illustrates formation of a dot of a second color ink superposed on the dot of FIG. 9A.

Referring to FIG. 9A, an ink droplet 901 ejected from a print head is applied to an unprinted region of a printing medium 902. Solvent contained in the ink of the ink droplet 901, applied to the printing medium 902, permeates the printing medium 902. A color material, serving as a solid content contained in the ink, fixes in a surface layer of the printing medium 902, thus forming a dot 903.

Referring to FIG. 9B, an ink droplet 904 ejected from the print head is applied to the printing medium 902 such that the ink droplet 904 is superposed on the dot 903 formed in the printing medium 902. Since the dot 903 has already been formed by applying the ink droplet 901 to the printing medium 902, the ink droplet 904 subsequently applied at the same position as that of the formed dot 903 permeates deeper than the dot 903 to a level at which a dot 905 is formed as illustrated in FIG. 9B. The reason is that the ink droplet first applied to the printing medium 902 increases wettability of the printing medium and the increased wettability facilitates permeation. Such deep permeation of the ink droplet subsequently applied to the printing medium allows the dot formed by the first ink droplet to remain in the surface layer of the printing medium, so that the color of the remaining dot appears dominantly. Although the dot 903 is separate from the dot 905 in FIG. 9B for convenience of illustration of permeation levels, part of a color material of the subsequent ink droplet 904 may remain in the surface layer.

To make dots formed by paper preliminary ejection less visible, processing liquid that enables aggregation of an ink dot may be applied to the printing medium in advance so that the two superposed dots do not spread laterally. Alternatively, the ink to be first applied and the ink to be subsequently applied may contain a component that allows aggregation of a color material so that the color materials of the first and subsequent inks are aggregated.

If the ink to be subsequently applied to the printing medium has higher permeability than the ink to be first applied to the printing medium, ink having low lightness may be first applied to the printing medium and ink having high lightness may be applied subsequently thereto. If the high permeability ink is applied to the printing medium before the color material of the low lightness ink first applied thereto fixes in the surface layer of the printing medium, the color material of the low lightness ink may be drawn together with the color material of the high permeability ink permeating the printing medium deeper than the low lightness ink, thus reducing the remaining color material of the low lightness ink in the surface layer. This makes the dots formed by the paper preliminary ejection less visible.

Although the yellow ink containing a yellow color material is used as ink having high lightness and the black ink containing a black color material is used as ink having low lightness in the embodiment, any other ink combination may be used. Any ink combination may be used which achieves an increase in lightness of dots formed on a printing medium by superposing a dot of ink having high lightness on a dot of ink having low lightness as compared with lightness of a dot formed using a single color ink. For example, the magenta ink containing a magenta color material or the cyan ink containing a cyan color material may be used instead of the black ink, serving as ink having low lightness. Alternatively, if a color material is capable of permeating a printing medium more deeply, clear ink containing no color material may be used as ink having high lightness. In the use of clear ink, the clear ink may be ejected so as to be superposed on each of the C, M, Y, and K inks. Alternatively, the clear ink may be ejected so as to be superposed on a specific color ink. Furthermore, any other combination that achieves the above-described effect may include light-color ink having a low color material density, for example, light cyan, light magenta, or gray, as either ink having low lightness or ink having high lightness. Alternatively, ink of a specific color, such as red, green, or blue, may be used.

In verification by the inventors of the present disclosure, in the case where the yellow ink was first applied to a printing medium and the black ink was subsequently applied thereto, the black ink permeated the printing medium and the yellow ink remained dominantly in a surface layer of the printing medium. A single dot of the black ink has low lightness significantly different from lightness of an unprinted region of a printing medium. The black-ink dot is accordingly visible. Applying the yellow ink so as to superpose a yellow-ink dot on the black-ink dot increases the lightness of the superposed dots, thus reducing the difference in lightness between the superposed dots and the unprinted region. This makes the black-ink dot less visible. Results of measurement of L values indicating lightness in the CIE-L*a*b* space, serving as a uniform color space, will now be described. In the measurement, PB paper (manufactured by CANON KABUSHIKI KAISHA) having an L value of approximately 90 was used. A region of the PB paper to which only the black ink was applied had an L value of approximately 3. A region of the PB paper to which the yellow ink was first applied and the black ink was subsequently applied had an L value of approximately 6. An increase in lightness was verified.

As described above, paper preliminary ejection data is generated so that dots of ink having high lightness are superposed on dots of ink having low lightness, thus making the dots formed by the preliminary ejection in an area where an image is to be printed less visible. In addition, superposing the dots on each other in the paper preliminary ejection can reduce the area of coverage by the dots formed by the paper preliminary ejection in a printing medium. Thus, a high definition image can be formed.

Second Embodiment

The first embodiment has been described with respect to the printer in which a printing medium is conveyed relative to the fixed print head. A second embodiment will be described with respect to a serial printer in which a print head is scanned relative to a printing medium.

Figure 3:
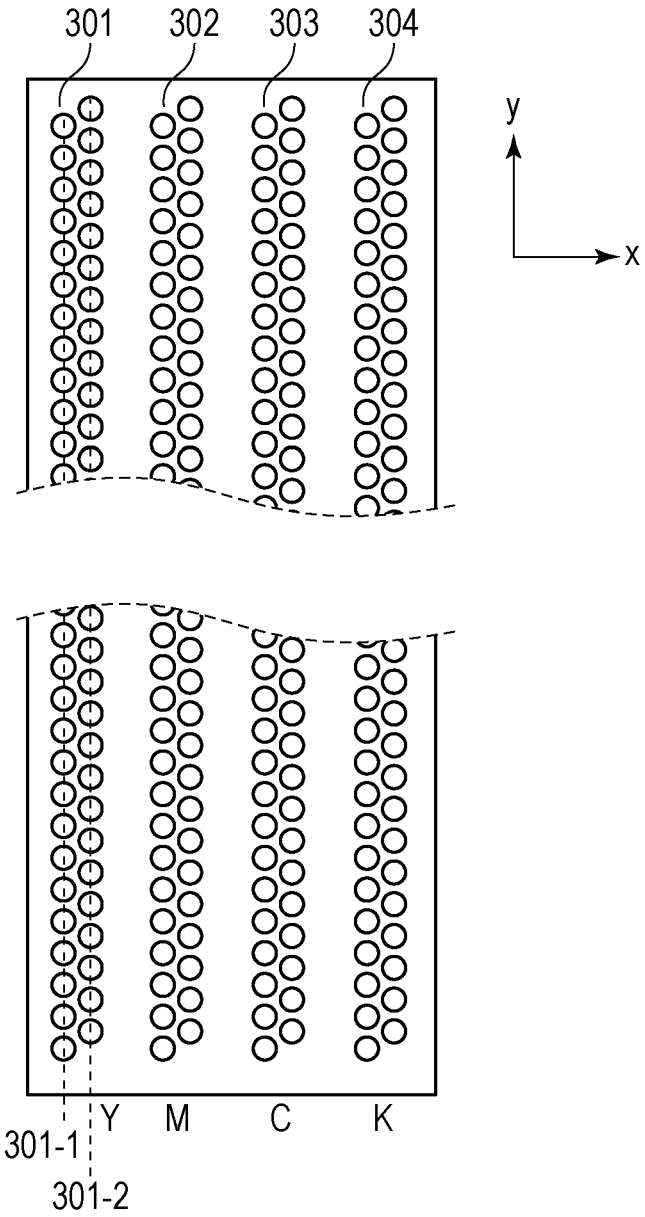
FIG. 3 is a schematic diagram partly illustrating nozzle arrays of a print head in a second embodiment.
Figure 4:
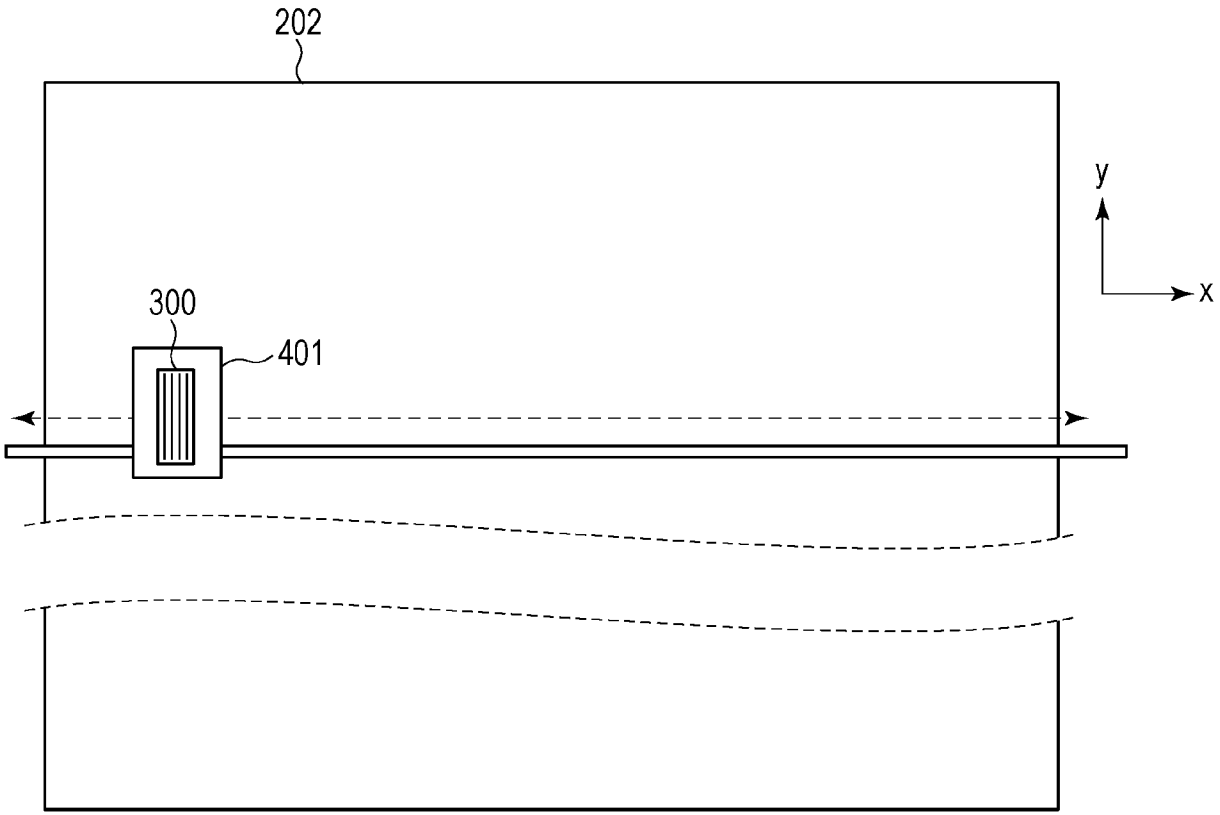
FIG. 4 is a schematic diagram illustrating positional relationship between the print head and a printing medium in the second embodiment.

FIG. 3 is a diagram explaining the print head in the second embodiment. FIG. 4 is a diagram explaining scanning of the print head and conveyance of a printing medium. In FIGS. 3 and 4, the printing medium is conveyed in the y direction and the print head is scanned in the x direction. A print chip 300 includes a plurality of nozzle arrays extending in the y direction, namely, a nozzle array 301 for yellow (Y) ink, a nozzle array 302 for magenta (M) ink, a nozzle array 303 for cyan (C) ink, and a nozzle array 304 for black (K) ink. Each nozzle array includes two nozzle columns (for example, nozzle columns 301-1 and 301-2) and nozzles in each column are arranged at a resolution of 600 dpi in a manner similar to the first embodiment. The adjacent nozzle columns 301-1 301-2 are arranged such that the nozzle column 301-1 is misaligned with the nozzle column 301-2 in the y direction by a half pitch, namely, 1/1200 inches. Consequently, the adjacent nozzle columns print rasters misaligned with each other in the y direction by 1/1200 inches. A printing resolution in the y direction is 1200 dpi.

FIG. 4 illustrates a print head 401 including the print chip 300. The print head 401 allows the nozzles to eject ink droplets while reciprocating in the x direction and a −x direction orthogonal to the y direction in which the nozzles are arranged, thereby printing an image. A mechanism for conveying a printing medium, a capping member, and a control system are similar to those in the first embodiment.

Figure 10:
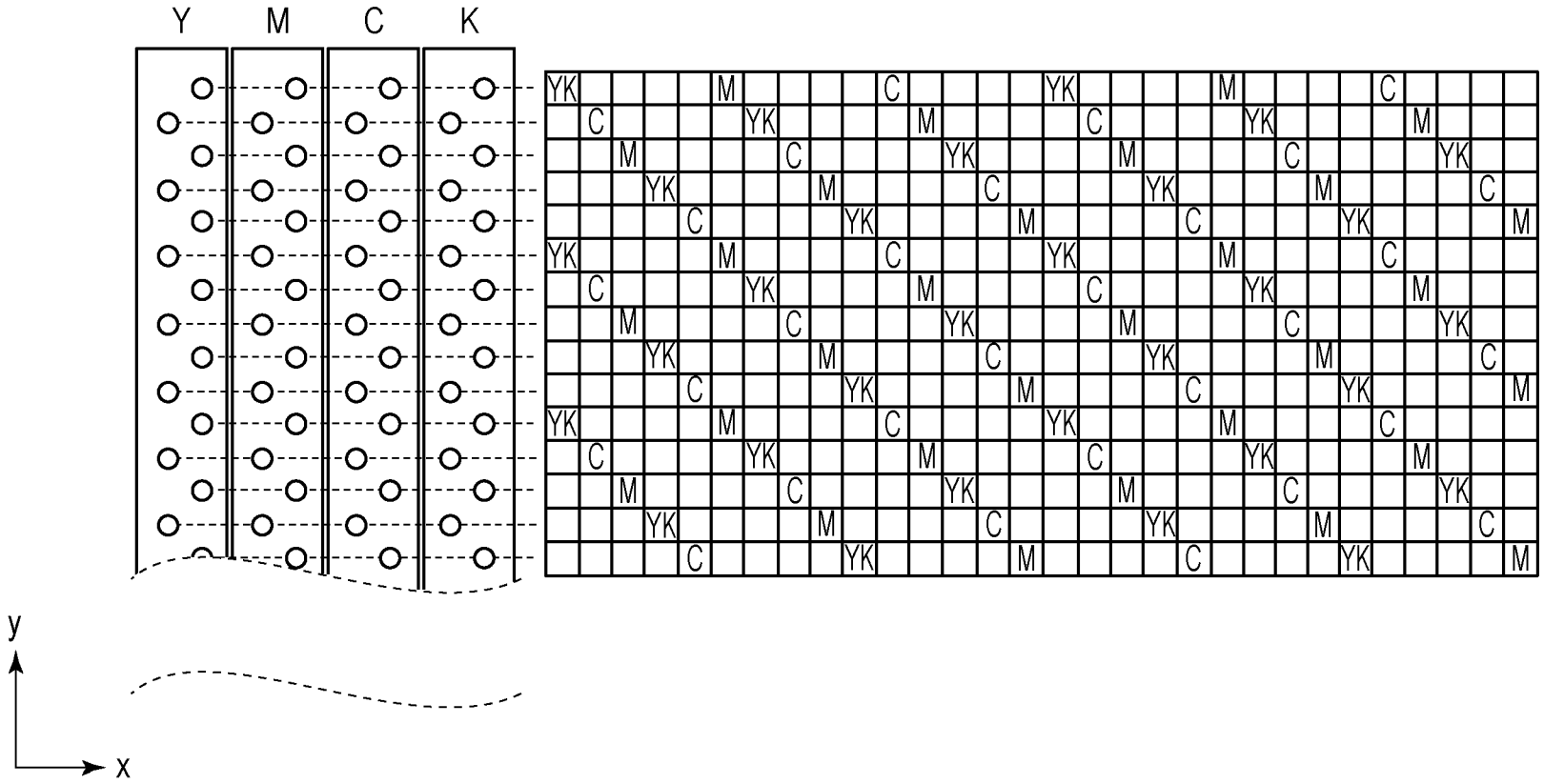
FIG. 10 is a diagram explaining arrangement of dots to be formed by paper preliminary ejection in the second embodiment.

FIG. 10 illustrates a pattern based on paper preliminary ejection data in the present embodiment. Referring to FIG. 10, each rectangular region represents a pixel that is a minimum unit to which an ink droplet is to be ejected or not to be ejected. Each of pixels with characters Y, M, C, and K is a pixel to which ink of the corresponding color is to be ejected. Dots of the yellow ink and dots of the black ink are printed such that each yellow-ink dot and a corresponding black-ink dot are superposed on each other in a single pixel in a manner similar to the first embodiment, thus making the dots formed by paper preliminary ejection less visible.

The printer for forming an image by scanning the print head 401 in a serial manner in this embodiment typically uses a multi-pass printing method of forming an image by a plurality of scanning operations. According to the multi-pass printing method, data to be printed for each scan is generated by thinning out image data about an image, which can be printed by scanning a print head once, using mask patterns associated with multiple print scans. The mask patterns associated with the respective scans are complementary to each other. A printing medium is conveyed by a conveyance amount less than a printable width of the print head for a period of time between print scans of the print head. For example, in multi-pass printing of two passes, image data is thinned out by approximately 50% with mask patterns used for print main scans and the conveyance amount is ½ the printable width of the print head. Such a print scanning operation and such a conveying operation are repeated, so that dots arranged in a pixel line (raster) extending in a main scanning direction are printed by two different nozzle groups. If there is a more or less variation between the nozzles, printing in a ½ distribution manner on a printing medium enables formation of an image smoother than that formed by one-pass printing. The multi-pass printing of two passes has been described above. As the number of passes (the number of divisions) of multi-pass printing is larger, a smoother image can be formed. The number of print scanning operations and the number of conveying operations, however, increase. This results in an increase in output time. To reduce output time to some extent, bidirectional multi-pass printing is often performed to eject ink in both forward scanning and backward scanning of a print head.

Figure 11A:
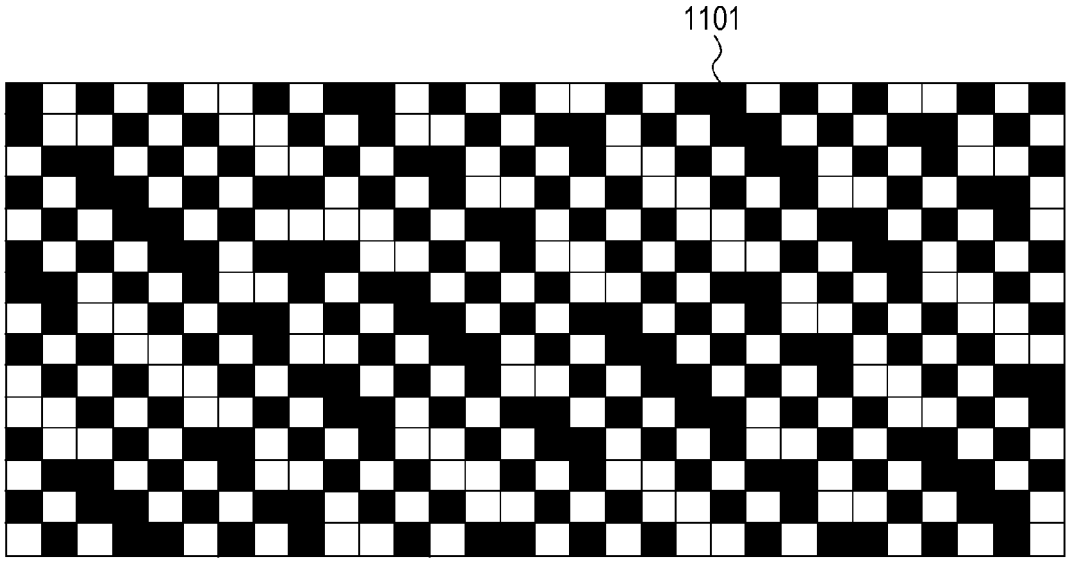
FIGS. 11A and 11B illustrate mask patterns in the second embodiment.
Figure 11B:
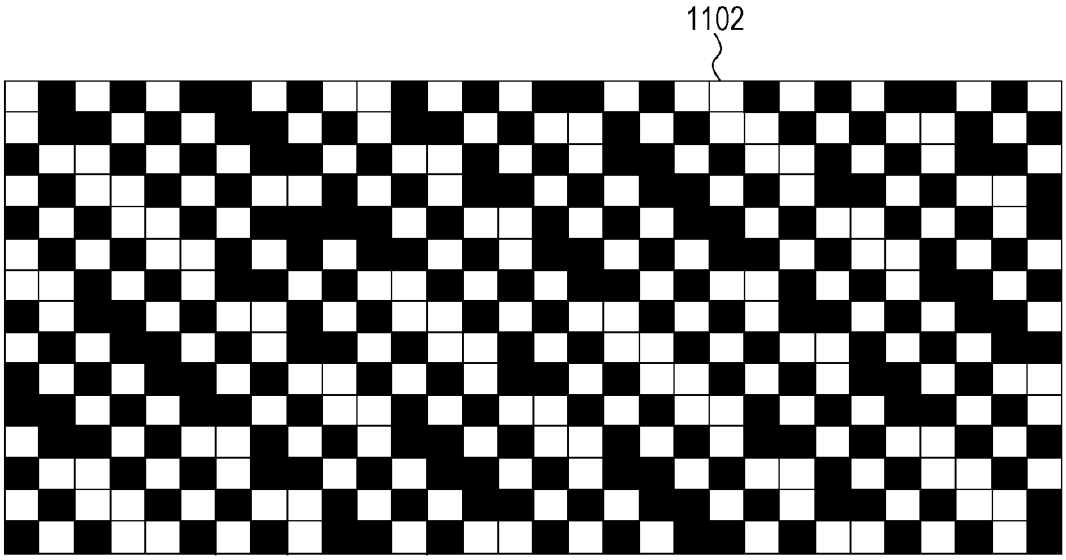

FIGS. 11A and 11B illustrate exemplary mask patterns used in the embodiment. In FIGS. 11A and 11B, each rectangular region represents a pixel that is a minimum unit in which dot printing is to be permitted or not to be permitted, and corresponds to one pixel on a printing medium. Each of black regions is a pixel (print permission pixel) in which ink printing is permitted in a print scan. Each of white regions is a pixel (print non-permission pixel) in which ink printing is not permitted in the print scan. FIGS. 11A and 11B each illustrate the mask pattern of 15×30 pixels corresponding to the pattern of FIG. 10. A mask pattern 1 (1101) and a mask pattern 2 (1102) are multi-pass (two-pass) printing mask patterns which are complementary to each other.

FIGS. 12A and 12B are schematic diagrams illustrating paper preliminary ejection data for printing using mask patterns applied to nozzle arrays in, for example, bidirectional two-pass printing. FIG. 12A illustrates forward printing of the bidirectional two-pass printing. In the forward printing, the mask pattern 2 is used for the Y ink and the mask pattern 1 is used for the M, C, and K inks. FIG. 12B illustrates backward printing of the bidirectional two-pass printing such that the backward printing is superposed on the forward printing of FIG. 12A. In the backward printing, the mask pattern 1 is used for the Y ink and the mask pattern 2 is used for the M, C, and K inks. Although dots of the Y ink are formed at positions identical to those in which dots of the K ink are formed in FIG. 12B, the order of application of Y-ink and K-ink dots on a printing medium may differ because of bidirectional two-pass printing. Referring to FIG. 12B, each pixel with characters YK is a pixel to which the Y ink was first applied and the K ink was subsequently applied, and each pixel with characters KY is a pixel to which the K ink was first applied and the Y ink was subsequently applied. The pixels with characters YK, in which the Y ink was first applied and the K ink was subsequently applied at a position identical to that of the Y ink, is allowed to have higher lightness than pixels in which only the K ink was ejected. In addition, dots are formed by two operations of paper preliminary ejection such that the dots are superposed on each other, thus reducing the area (coverage) of the dots formed by the paper preliminary ejection on a printing medium. Consequently, the dots formed by the paper preliminary ejection are made further less visible. In the embodiment, serial bidirectional printing is performed using the print head including a nozzle array for each of the colors. The ratio of pixels in which the K ink was applied after the Y ink to pixels in which the Y ink was applied after the K ink is 1:1. Furthermore, the inks can be superposed on each other in the same order at any time by using a mirror head that includes nozzle arrays such that the order of application of the inks in forward scanning is the same as that in backward scanning. For example, assuming that the print head includes nozzle arrays for the Y, C, M, K, M, C, and K inks arranged in that order, the Y ink is applied prior to the K ink in each of forward scanning and backward scanning. Although the mask patterns for applying the two different color inks to be superposed on each other in different passes of two-pass printing are used as paper preliminary ejection patterns in the embodiment, mask patterns for applying the two different color inks so as to superpose the inks in the same pass may be used. Distribution of dots superposed in passes is not limited to that using mask patterns. The distribution may be achieved by generating paper preliminary ejection data for forward scanning and that for backward scanning. In addition, assuming that dots are superposed on each other by paper preliminary ejection in the same pass, the color of ink to be first applied in the forward direction does not have to be identical to that of ink to be first applied in the backward direction. Superposition of dots formed by paper preliminary ejection in the same pass may be achieved in any order of application of the different color inks. For example, the Y ink may be first applied in the forward direction and the M ink may be first applied in the backward direction.

Third Embodiment

The first and second embodiments have been described with respect to the case where paper preliminary ejection data is generated so that two different types of ink are superposed on each other in order to make dots less visible. Verification by the inventors of the present disclosure has revealed that the extent of effect differs depending on the type of printing medium or permeation property of ink. For example, a printing medium that readily permits permeation, for example, plain paper, has a tendency to readily provide an increase in lightness caused by superposition of two different color inks. On the other hand, glossy paper or paper intended only for ink jet printing tends to allow the color material of ink to remain in upper part of an ink absorbing layer of such a printing medium. This printing medium may be less likely to achieve an increase in lightness caused by superposition of two different color inks. In such a case, the processing of generating paper preliminary ejection data in step S805 in FIG. 8 can be changed.

Figure 13:
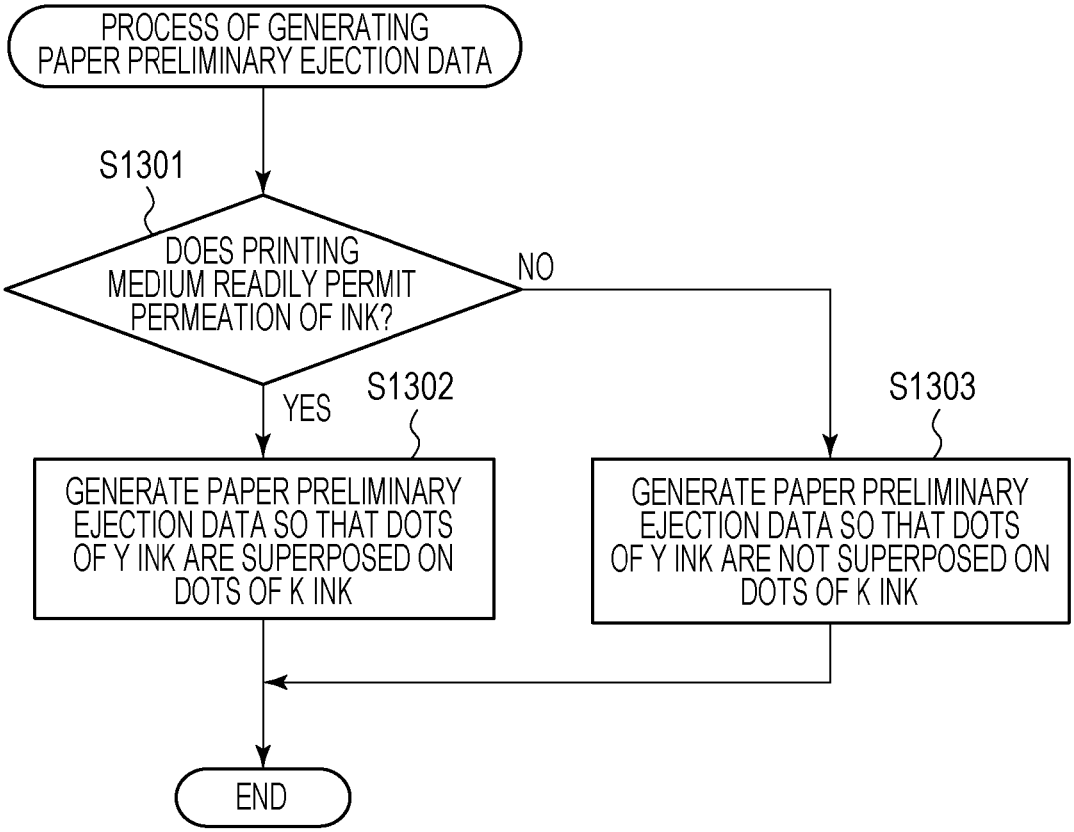
FIG. 13 is a flowchart of a process in a third embodiment.

FIG. 13 illustrates a modification of the process of generating paper preliminary ejection data in step S805. In step S1301, the type of printing medium on which an image is to be printed is determined. If a printing medium that readily permits permeation of ink, for example, plain paper, is determined, the process proceeds to step S1302, where paper preliminary ejection data is generated so that yellow-ink dots and black-ink dots are formed so as to be superposed on each other. If a printing medium that does not tend to permit permeation of ink, for example, paper intended only for ink jet printing or glossy paper, is determined, the process proceeds to step S1303, where pixels for formation of the yellow-ink dots are made different from those for formation of the black-ink dots in order to prevent superposition of the yellow-ink and black-ink dots.

As described above, the effect of making dots less visible by superposing the dots on each other varies depending on the type of printing medium. According to this modification, paper preliminary ejection data can be properly generated depending on the type of printing medium.

Other Embodiments

Additional exemplary embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like. As regards formation of dots by superposition, the dots do not necessarily have to be superposed on each other in a single pixel. Whether to superpose dots on each other may be determined depending on a printing resolution and the size of each dot formed on a printing medium. For example, assuming that a dot to be actually formed has a larger size than each pixel virtually set on a printing medium, ink having high lightness and ink having low lightness may be ejected to two adjacent pixels, thus forming overlap of dots. Furthermore, each dot of the ink having high lightness does not have to be superposed on each dot of the ink having low lightness in preliminary ejection. The effect of making the dots less visible can be achieved by overlapping the dots.

According to aspects of the present disclosure, the difference between the lightness of dots formed by paper preliminary ejection and the lightness of an image surrounding the dots or the lightness of a printing medium is reduced, thus making the dots, formed by the preliminary ejection, less visible.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-094815, filed May 1, 2014 which is hereby incorporated by reference herein in its entirety.

What is claimed is:

1. A method of printing an image on a printing medium using a print head ejecting a first ink, a second ink having higher lightness than the first ink, and a third ink having lower lightness than the second ink, the method comprising:

preliminarily ejecting the first ink in a predetermined area;

preliminarily ejecting the second ink in the predetermined area;

preliminarily ejecting the third ink in the predetermined area; and ejecting ink in the predetermined area to form the image, wherein preliminarily ejecting the first ink, the second ink and the third ink is performed to maintain an ink ejection state of the print head without contributing to image formation, wherein dots of the first ink and dots of the second ink formed in the predetermined area by the preliminary ejection are printed to be superposed on each other, and wherein the dots of the second ink and dots of the third ink formed in the predetermined area by the preliminary ejection are printed not to be superposed on each other.

2. The method according to claim 1, wherein a first region has higher lightness than a second region, wherein the first region is a region in which each of the dots of the first ink and a corresponding one of the dots of the second ink formed by the preliminary ejection are superposed on each other and the second region is a region in which only a dot of the first ink is formed on the printing medium.

3. The method according to claim 1, wherein the second ink is ejected prior to the first ink.

4. The method according to claim 1, wherein the first ink contains a black color material or a magenta color material.

5. The method according to claim 1, wherein the second ink contains a yellow color material.

6. The method according to claim 1, wherein the print head includes a first nozzle array having nozzles ejecting the first ink arranged in a first direction and a second nozzle array having nozzles ejecting the second ink arranged in the first direction, and wherein the image is printed on the printing medium moved in a second direction orthogonal to the first direction relative to the print head.

7. The method according to claim 1, wherein the third ink contains a cyan color material.

8. The method according to claim 1, wherein the third ink has higher lightness than the first ink.

9. A printing apparatus for printing an image on a printing medium, the printing apparatus comprising:

a printing medium storage unit configured to store the printing medium;

a storage unit configured to store image data;

an image processing unit configured to generate print data based on the stored image data; and a print head configured to eject ink on a printing medium fed from the printing medium storage unit based on the print data to form the image on the printing medium, wherein the print head is further configured to preliminarily eject a first ink, a second ink having higher lightness than the first ink, and a third ink having lower lightness than the second ink, in a predetermined area in which the image is to be formed in order to maintain an ink ejection state of the print head, wherein ejection of the first ink and the second ink does not contribute to image formation, wherein dots of the first ink and dots of the second ink formed in the predetermined area by the preliminary ejection are printed to be superposed on each other, and wherein the dots of the second ink and dots of the third ink formed in the predetermined area by the preliminary ejection are printed not to be superposed on each other.

10. The apparatus according to claim 9, wherein a first region has higher lightness than a second region, wherein the first region is a region in which each of the dots of the first ink and a corresponding one of the dots of the second ink formed by the preliminary ejection are superposed on each other and the second region is a region in which only a dot of the first ink is formed on the printing medium.

11. The apparatus according to claim 9, wherein the second ink is ejected prior to the first ink.

12. The apparatus according to claim 9, wherein the first ink contains a black color material or a magenta color material.

13. The apparatus according to claim 9, wherein the second ink contains a yellow color material.

14. The apparatus according to claim 9, wherein the print head includes a first nozzle array having nozzles ejecting the first ink arranged in a first direction and a second nozzle array having nozzles ejecting the second ink arranged in the first direction, and wherein the image is printed on the printing medium moved in a second direction orthogonal to the first direction relative to the print head.

15. The apparatus according to claim 9, wherein the third ink contains a cyan color material.

16. An image processing apparatus for processing image data corresponding to an image to be printed on a printing medium, in order to generate first printing data which is used for ejecting a first ink and second printing data which is used for ejecting a second ink having higher lightness than the first ink from a print head, wherein the first printing data defines whether the first ink is ejected to each of a plurality of pixel areas on the printing medium, and the second printing data defines whether the second ink is ejected to each of the plurality of pixel areas on the printing medium, the image processing apparatus comprising;

a first generating unit configured to generate first quantization data corresponding to the image to be printed by ejecting the first ink based on the image data, and generate second quantization data corresponding to the image to be printed by ejecting the second ink based on the image data, wherein the first quantization data defines whether the first ink is ejected to each of the plurality of pixel areas on the printing medium for printing the image, and the second quantization data defines whether the second ink is ejected to each of the plurality of pixel areas on the printing medium for printing the image;

a second generating unit configured to generate first preliminary ejection data corresponding to a preliminary ejection pattern to be printed by ejecting the first ink, and generate second preliminary ejection data corresponding to a preliminary ejection pattern to be printed by the second ink, wherein the first preliminary ejection data defines whether the first ink is ejected to each of the plurality of pixel areas on the printing medium for printing the preliminary ejection pattern, and the second preliminary ejection data defines whether the second ink is ejected to each of the plurality of pixel areas on the printing medium for printing the preliminary ejection pattern, and wherein the preliminary ejection pattern is a pattern printed for maintaining an ink ejection state of the print head; and a third generating unit configured to generate the first printing data based on the first quantization data generated by the first generating unit and the first preliminary ejection data by the second generating unit, and generate the second printing data based on the second quantization data by the first generating unit and the second preliminary ejecting data by the second generating unit, wherein the second generating unit generates the first and second preliminary ejection data such that the plurality of pixel areas to which the first ink is defined to be ejected by the first preliminary ejection data overlap with the plurality of pixel areas to which the second ink is defined to be ejected by the second preliminary ejection data.

17. The image processing apparatus according to claim 16, wherein the second generating unit generates the first and second preliminary ejection data such that the plurality of pixel areas to which the first ink is defined to be ejected by the first preliminary ejection data coincide with the plurality of pixel areas to which the second ink is defined to be ejected by the second preliminary ejection data.

18. The image processing apparatus according to claim 16, wherein the print head further ejects a third ink having lower lightness than the second ink and higher lightness than the first ink, wherein the first generating unit further generates third quantization data corresponding to the image to be printed by ejecting the third ink based on the image data, wherein the third quantization data defines whether the third ink is ejected to each of the plurality of pixel areas on the printing medium for printing the image, wherein the second generating unit further generates third preliminary ejection data corresponding to a preliminary ejection pattern to be printed by ejecting the third ink, wherein the third preliminary ejection data defines whether the third ink is ejected to each of the plurality of pixel areas on the printing medium for printing the preliminary ejection pattern, wherein the third generating unit further generates third printing data which is used for ejecting the third ink based on the third quantization data by the first generating unit and the third preliminary ejecting data by the second generating unit, wherein the third printing data defines whether the third ink is ejected to each of the plurality of pixel areas on the printing medium, and wherein the second generating unit generates the first, second and third preliminary ejection data such that the plurality of pixel areas to which the third ink is defined to be ejected by the third preliminary ejection data do not overlap with the plurality of pixel areas to which the first ink is defined to be ejected by the first preliminary ejection data and the plurality of pixel areas to which the second ink is defined to be ejected by the second preliminary ejection data.

19. The image processing apparatus according to claim 16, wherein the third generating unit generates the first printing data by performing logical sum operation of the first quantization data generated by the first generating unit and the first preliminary ejection data by the second generating unit, and generates the second printing data by performing logical sum operation of the second quantization data by the first generating unit and the second preliminary ejecting data by the second generating unit.

20. An image processing method for an image processing apparatus for processing image data corresponding to an image to be printed on a printing medium, in order to generate first printing data which is used for ejecting a first ink and second printing data which is used for ejecting a second ink having higher lightness than the first ink from a print head, wherein the first printing data defines whether the first ink is ejected to each of a plurality of pixel areas on the printing medium, and the second printing data defines whether the second ink is ejected to each of the plurality of pixel areas on the printing medium, the image processing method comprising;

a first generating step of generating first quantization data corresponding to the image to be printed by ejecting the first ink based on the image data, and generating second quantization data corresponding to the image to be printed by ejecting the second ink based on the image data, wherein the first quantization data defines whether the first ink is ejected to each of the plurality of pixel areas on the printing medium for printing the image, and the second quantization data defines whether the second ink is ejected to each of the plurality of pixel areas on the printing medium for printing the image;

a second generating step of generating first preliminary ejection data corresponding to a preliminary ejection pattern to be printed by ejecting the first ink, and generating second preliminary ejection data corresponding to a preliminary ejection pattern to be printed by the second ink, wherein the first preliminary ejection data defines whether the first ink is ejected to each of the plurality of pixel areas on the printing medium for printing the preliminary ejection pattern, and the second preliminary ejection data defines whether the second ink is ejected to each of the plurality of pixel areas on the printing medium for printing the preliminary ejection pattern, and wherein the preliminary ejection pattern is a pattern printed for maintaining an ink ejection state of the print head; and a third generating step of generating the first printing data based on the first quantization data generated in the first generating step and the first preliminary ejection data in the second generating step, and generating the second printing data based on the second quantization data in the first generating step and the second preliminary ejecting data in the second generating step, wherein the second generating step generates the first and second preliminary ejection data such that the plurality of pixel areas to which the first ink is defined to be ejected by the first preliminary ejection data overlap with the plurality of pixel areas to which the second ink is defined to be ejected by the second preliminary ejection data.

* * * * *